US009499390B1

(12) United States Patent
Newton et al.

(10) Patent No.: US 9,499,390 B1
(45) Date of Patent: Nov. 22, 2016

(54) LIQUID DELIVERY SYSTEM

(71) Applicant: GLOBAL AGRICULTURAL TECHNOLOGY AND ENGINEERING, LLC, Vero Beach, FL (US)

(72) Inventors: John R. Newton, Vero Beach, FL (US); Michael E. Cheney, Vero Beach, FL (US); Peter J. Brooke, Micco, FL (US); Scott Ross, Sebastian, FL (US)

(73) Assignee: GLOBAL AGRICULTURAL TECHNOLOGY AND ENGINEERING, LLC, Vero Beach, FL (US)

( * ) Notice: Subject to any disclaimer, the term of this patent is extended or adjusted under 35 U.S.C. 154(b) by 0 days.

(21) Appl. No.: 13/904,532

(22) Filed: May 29, 2013

Related U.S. Application Data

(63) Continuation of application No. 13/681,601, filed on Nov. 20, 2012, now abandoned.

(60) Provisional application No. 61/672,465, filed on Jul. 17, 2012.

(51) Int. Cl.
*B67D 7/78* (2010.01)
*B67D 7/74* (2010.01)

(52) U.S. Cl.
CPC ..... *B67D 7/74* (2013.01)

(58) Field of Classification Search
CPC ..... G05D 16/0655; G05D 16/0608; G05D 16/0672; G05D 11/132; B05B 12/087; B05B 7/26; B67D 1/0016; B67D 1/1204; B67D 1/1295; F16K 11/044
USPC ..... 222/129, 129.1, 132, 135, 145.1, 145.5
See application file for complete search history.

(56) References Cited

U.S. PATENT DOCUMENTS 1,948,401 A * 2/1934 Smith et al. ..... 137/255
2,504,117 A * 4/1950 Downs ..... 427/280

(Continued)

FOREIGN PATENT DOCUMENTS

CN 1738764 A 2/2006
CN 1744953 A 3/2006

(Continued)

OTHER PUBLICATIONS

Orifice—Definitiona nd More from the Free Merriam-Webster Dictionary.pdf.*

(Continued)

*Primary Examiner* — Patrick M Buechner
*Assistant Examiner* — Randall Gruby
(74) *Attorney, Agent, or Firm* — Gesmer Updegrove LLP

(57) ABSTRACT

A system for the on demand delivery of a liquid mixture to an on/off dispenser comprises a mixing chamber having first and second inlets and an outlet connected to the dispenser. A first constant flow valve has a first outlet connected to the first inlet via a first supply line. The first constant flow valve is adapted to deliver a first liquid to the mixing chamber at a first substantially constant pressure. A second constant flow valve has a second outlet connected to the second inlet via a second supply line. The size of the second inlet is at least as large as the size of the second outlet. The second constant flow valve is adapted to deliver a second liquid to the mixing chamber at a second pressure greater than the first pressure, with the second pressure being determined primarily by the flow resistance of the second supply line. At least one of the first and second liquids, or a third liquid delivered to the mixing chamber via a third supply line, may be atomized. Compressed air may be introduced into the mixing chamber to enhance liquid mixing.

5 Claims, 2 Drawing Sheets

(56) References Cited

U.S. PATENT DOCUMENTS

| | | | | |
|---|---|---|---|---|
| 2,513,081 | A * | 6/1950 | Clark et al. | 239/307 |
| 2,755,979 | A * | 7/1956 | Lawson et al. | 141/100 |
| 2,986,306 | A * | 5/1961 | Cocanour | 222/129.1 |
| 3,049,439 | A * | 8/1962 | Coffman | 427/137 |
| 3,093,311 | A * | 6/1963 | Morris et al. | 239/142 |
| 3,179,341 | A * | 4/1965 | Plos et al. | 239/414 |
| 3,198,394 | A * | 8/1965 | Lefer | 222/135 |
| 3,306,495 | A * | 2/1967 | Wabers | 222/77 |
| 3,403,695 | A * | 10/1968 | Hopkins | 137/240 |
| 3,588,053 | A * | 6/1971 | Rothermel | 366/131 |
| 3,592,385 | A * | 7/1971 | Smith | 239/10 |
| 3,596,802 | A * | 8/1971 | Feldman | 222/135 |
| 4,006,841 | A * | 2/1977 | Alticosalian | 222/42 |
| 4,062,220 | A | 12/1977 | Taube et al. | |
| 4,090,262 | A * | 5/1978 | Schneider et al. | 366/155.1 |
| 4,111,613 | A * | 9/1978 | Sperry | 417/394 |
| 4,159,028 | A * | 6/1979 | Barker et al. | 141/9 |
| 4,173,296 | A * | 11/1979 | Marshall | 222/129.1 |
| RE30,301 | E * | 6/1980 | Zygiel | 137/564.5 |
| 4,390,035 | A * | 6/1983 | Hill | 137/99 |
| 4,549,674 | A * | 10/1985 | Alticosalian | 222/48 |
| 4,714,545 | A * | 12/1987 | Bente et al. | 210/101 |
| 4,789,100 | A * | 12/1988 | Senf | 239/61 |
| 4,809,909 | A * | 3/1989 | Kukesh | 239/1 |
| 4,964,732 | A * | 10/1990 | Cadeo et al. | 366/152.1 |
| 4,979,644 | A * | 12/1990 | Meyer et al. | 222/94 |
| 5,016,665 | A * | 5/1991 | Konieczynski | 137/1 |
| 5,058,610 | A * | 10/1991 | Kuriyama | 134/98.1 |
| 5,064,100 | A * | 11/1991 | Mural | 222/143 |
| 5,152,431 | A * | 10/1992 | Gardner et al. | 222/136 |
| 5,219,097 | A * | 6/1993 | Huber et al. | 222/145.2 |
| 5,292,030 | A * | 3/1994 | Kateman et al. | 62/74 |
| 5,388,761 | A | 2/1995 | Langeman | |
| 5,398,846 | A * | 3/1995 | Corba et al. | 222/1 |
| 5,405,083 | A * | 4/1995 | Moses | 239/9 |
| 5,662,922 | A * | 9/1997 | Christensen | 424/438 |
| 5,685,639 | A * | 11/1997 | Green | 366/101 |
| 5,741,554 | A * | 4/1998 | Tisone | 427/424 |
| 5,803,109 | A * | 9/1998 | Rosen | 137/15.05 |
| 5,810,254 | A * | 9/1998 | Kropfield | 239/61 |
| 5,868,279 | A * | 2/1999 | Powell | 222/59 |
| 5,887,755 | A * | 3/1999 | Hood, III | 222/135 |
| 6,026,850 | A | 2/2000 | Newton et al. | |
| 6,116,261 | A * | 9/2000 | Rosen | 137/15.04 |
| 6,173,862 | B1 * | 1/2001 | Buca et al. | 222/1 |
| 6,209,578 | B1 | 4/2001 | Newton | |
| 6,223,788 | B1 * | 5/2001 | Taylor | 141/9 |
| 6,283,329 | B1 * | 9/2001 | Bezaire et al. | 222/145.2 |
| 6,315,161 | B1 * | 11/2001 | Bezaire et al. | 222/1 |
| 6,533,189 | B2 * | 3/2003 | Kott et al. | 239/8 |
| 6,554,207 | B2 * | 4/2003 | Ebberts | 239/146 |
| 6,793,098 | B2 * | 9/2004 | Huber et al. | 222/1 |
| 6,988,641 | B2 | 1/2006 | Jones et al. | |
| 7,036,686 | B2 | 5/2006 | Newton | |
| 7,066,215 | B1 * | 6/2006 | Hewlitt et al. | 141/9 |
| 7,311,225 | B2 | 12/2007 | Newton | |
| 7,338,557 | B1 * | 3/2008 | Chen et al. | 118/300 |
| 7,341,630 | B1 * | 3/2008 | Pacetti | 118/300 |
| 7,363,938 | B1 | 4/2008 | Newton | |
| 7,395,948 | B2 * | 7/2008 | Kogan | 222/136 |
| 7,445,021 | B2 | 11/2008 | Newton | |
| 7,533,786 | B2 * | 5/2009 | Woolfson et al. | 222/144.5 |
| 7,617,839 | B2 | 11/2009 | Newton | |
| 7,775,401 | B2 * | 8/2010 | Banco et al. | 222/136 |
| 7,775,745 | B2 * | 8/2010 | Simmons et al. | 405/259.6 |
| 7,819,289 | B2 * | 10/2010 | Willis | 222/190 |
| 7,875,001 | B2 * | 1/2011 | Minotti | 604/82 |
| 8,002,151 | B2 * | 8/2011 | Matthews et al. | 222/190 |
| 8,100,347 | B2 * | 1/2012 | Nabeshima | B05B 3/1014 118/629 |
| 8,342,372 | B2 * | 1/2013 | Choiniere | B05B 9/007 222/145.5 |
| 8,540,120 | B2 * | 9/2013 | Newton et al. | 222/129.3 |
| 8,596,498 | B2 * | 12/2013 | Werner et al. | 222/136 |
| 8,641,662 | B2 * | 2/2014 | Barker, Jr. | A61B 17/00491 604/518 |
| 2002/0170925 | A1 * | 11/2002 | Friedman | 222/129.1 |
| 2003/0075573 | A1 * | 4/2003 | Bailey | 224/148.2 |
| 2003/0196595 | A1 * | 10/2003 | Takeshita et al. | 118/58 |
| 2004/0060946 | A1 * | 4/2004 | Floyd et al. | 222/132 |
| 2004/0144802 | A1 * | 7/2004 | Newton | 222/129.1 |
| 2004/0240311 | A1 * | 12/2004 | Hashiba | 366/101 |
| 2005/0103889 | A1 * | 5/2005 | Langeman | 239/303 |
| 2005/0155984 | A1 * | 7/2005 | Newton | 222/145.5 |
| 2006/0011655 | A1 * | 1/2006 | Ophardt | 222/190 |
| 2007/0000947 | A1 * | 1/2007 | Lewis et al. | 222/132 |
| 2007/0129680 | A1 * | 6/2007 | Hagg et al. | 604/151 |
| 2008/0094935 | A1 * | 4/2008 | Newton et al. | 366/132 |
| 2009/0152298 | A1 * | 6/2009 | Woolfson et al. | 222/144.5 |
| 2011/0121034 | A1 * | 5/2011 | Swab et al. | 222/145.1 |
| 2011/0259919 | A1 * | 10/2011 | Choiniere et al. | 222/135 |
| 2012/0113744 | A1 * | 5/2012 | Malboeuf | B05B 7/149 366/336 |
| 2012/0275867 | A1 * | 11/2012 | Jones | B65B 29/10 405/259.6 |
| 2012/0279990 | A1 * | 11/2012 | Werner | B05B 11/3083 222/132 |
| 2013/0056493 | A1 * | 3/2013 | Newton et al. | 222/129.3 |

FOREIGN PATENT DOCUMENTS

| | | | |
|---|---|---|---|
| CN | 101370412 | A | 2/2009 |
| WO | 0226614 | A2 | 4/2002 |
| WO | 2007120052 | A2 | 10/2007 |

OTHER PUBLICATIONS

International Search Report and Written Opinion mailed on Dec. 3, 2013 in connection with International Application PCT/US2013/049537, 11 pages.

International Preliminary Report on Patentability issued in PCT Application No. PCT/US2013/049537 Jan. 29, 2015.

EP partial search report issued in connection with corresponding EP application No. 1381999 mailed on Jan. 27, 2016.

The Chinese Office Action issued in connection with corresponding Chinese Application No. 201380037422.X issued on Feb. 29, 2016 and English translation thereof.

The Chinese Search Report issued in connection with corresponding Chinese Application No. 201380037422.X and English translation thereof.

Extended European Search Report issued in EP Application No. 13819995.5 Jun. 28, 2016.

* cited by examiner

LIQUID DELIVERY SYSTEM

CROSS REFERENCE TO RELATED APPLICATIONS

This application claims benefit, under 35 U.S.C. §119(e), of U.S. Provisional Application Ser. No. 61/672,465 filed on Jul. 17, 2012, and U.S. Utility application Ser. No. 13/681,601 filed Nov. 20, 2012, the contents and substance of which are herein incorporated by reference.

BACKGROUND

1. Field of the Invention

This invention relates generally to liquid delivery systems, and is concerned in particular with the on demand mixture and constant flow delivery of multiple liquids, some of which may have elevated viscosities and/or levels of suspended solids, and others of which may require delivery at extremely high ratios.

2. Description of Related Art

As herein employed, the term "on demand" means a system in which the mixture of liquid components occurs in response to and simultaneously with delivery of the resulting mixture.

With reference to FIG. 1, a prior on demand liquid mixing and delivery system is generally depicted at 10 and includes a mixing chamber 12. A first liquid component, which may for example be water received via a conduit 13 from a municipal water source, is supplied to the mixing chamber via a first supply line 14. The first supply line includes a first constant flow valve 16, a downstream metering orifice 18 and an optional check valve 20.

As herein employed, the term "constant flow valve" means a flow control valve of the type described, for example, in any one of U.S. Pat. Nos. 7,617,839; 6,026,850 or 6,209,578, the descriptions of which are herein incorporated by reference in their entirety.

These types of valves are normally closed, are opened in response to pressures exceeding a lower threshold level, are operative at pressures between the lower threshold level and an upper threshold level to deliver liquids at a substantially constant pressures, and are again closed at pressures above the upper threshold level.

A second liquid component, e.g., a tea concentrate, is received via conduit 22 and is supplied to the mixing chamber 12 via a second supply line 24. Conduit 22 is connected to a pressurized source of the second liquid component, one non limiting example being a pump 26, which may be driven by compressed air received via conduit 27. The second supply line includes a second constant flow valve 28, a downstream second metering orifice 30 having a fixed size, and another optional check valve 32. The first and second constant flow valves 16, 28 serve to deliver the first and second liquid components to the mixing chamber 12 at substantially constant pressures, irrespective of variations in the input pressures in the conduits 13, 22 between the upper and lower threshold levels of the valves, and at substantially constant flow rates governed by the flow resistances of the first and second metering orifices 18, 30.

The first and second liquid components are combined in the mixing chamber to produce a liquid mixture having a mix ratio governed by the selected variable size of the first metering orifice 18 and the fixed size of the second metering orifice 30.

Although not shown, it will be understood that the locations of the first and second metering orifices 18, 30 may be reversed, with the adjustable metering orifice 18 being located in the second supply line 24 and the fixed metering 30 orifice being located in the first supply line 14. Alternatively, the first and second supply lines 14, 24 may both be equipped with either fixed or adjustable orifices.

A discharge line 34 leads from the mixing chamber 12 and through which the liquid mixture is delivered to an on/off dispenser 36. A third metering orifice 38 is provided in the discharge line 34. As shown, the third metering orifice is upstream and separate from the dispenser 36. Alternatively, the third metering orifice may be included as an integral component of the dispenser.

When the dispenser is open, the discharge line 34 has a maximum flow rate that is lower than the combined minimum flow rates of the first and second supply lines 14, 24, thus creating back pressures in the first and second supply lines downstream of their respective constant flow valves 16, 28. These back pressures, together with the inlet pressures applied to the constant flow valves, maintain the constant flow valves open, thereby delivering the first and second liquid components to the mixing chamber at substantially constant pressures and flow rates.

For many applications, the above described system operates in a generally satisfactory manner, although there are certain applications that can be potentially problematic. For example, when the second liquid component has an elevated viscosity and/or level of suspended solids, and the ratio of the first liquid to the second liquid is relatively high, e.g., 400:1 there is a danger that the metering orifice 30 in the second supply line 24 will become plugged, necessitating a shut down of the system while the metering orifice is either cleaned or replaced. Such maintenance procedures are both disruptive and costly.

Even when the second liquid has a relatively low viscosity and has little if any suspended solids, its mixture with the first liquid at extremely high ratios on the order of 1000:1 can be difficult if not impossible to achieve due to limitations imposed by the metering orifices.

Also, for certain liquid combinations, adequate mixture in the mixing chamber 12 may be difficult to achieve, resulting in a less than a homogeneous mixture being delivered to the dispensing valve.

SUMMARY OF THE INVENTION

Broadly stated, the objective of the present invention is to provide an improved on demand liquid mixing and delivery system which addresses each of the above described shortcomings of the prior liquid delivery system.

In accordance with one aspect of the present invention, an on demand liquid mixing and delivery system comprises a manifold defining a mixing chamber. The manifold has first and second inlets communicating with the mixing chamber, and an outlet connected to an on/off dispenser. A first constant flow valve has a first outlet connected to the first manifold inlet via a first supply line. The first constant flow valve is adapted to deliver a first liquid to the mixing chamber at a substantially constant first pressure. A second constant flow valve has a second outlet connected to the second manifold inlet via a second supply line. The size of the second manifold inlet is at least as large as the size of the second outlet. The second constant flow valve is adapted to deliver a second liquid to the mixing chamber at a substantially constant second pressure greater than the first pressure.

The second supply conduit lacks any metering orifice. Instead, flow resistance in the second conduit is provided primarily by the length and/or internal size of at least a section of the second conduit, with that section advantageously being readily interchangeable with other sections having different lengths and/or internal sizes selected to provide flow resistances suitable for fluids having different viscosities and/or levels of suspended solids.

According to another aspect of the present invention, extremely high ratios can be achieved by atomizing one or more of the liquid components of the liquid mixture being delivered to the dispenser.

According to still another aspect of the present invention, mixture of the liquid components may be enhanced by the introduction of pressurized air into the mixing chamber.

These and other objectives, features and advantages of the present invention will now be described in greater detail with reference to the accompanying drawings, wherein:

DETAILED DESCRIPTION

Figure 1:
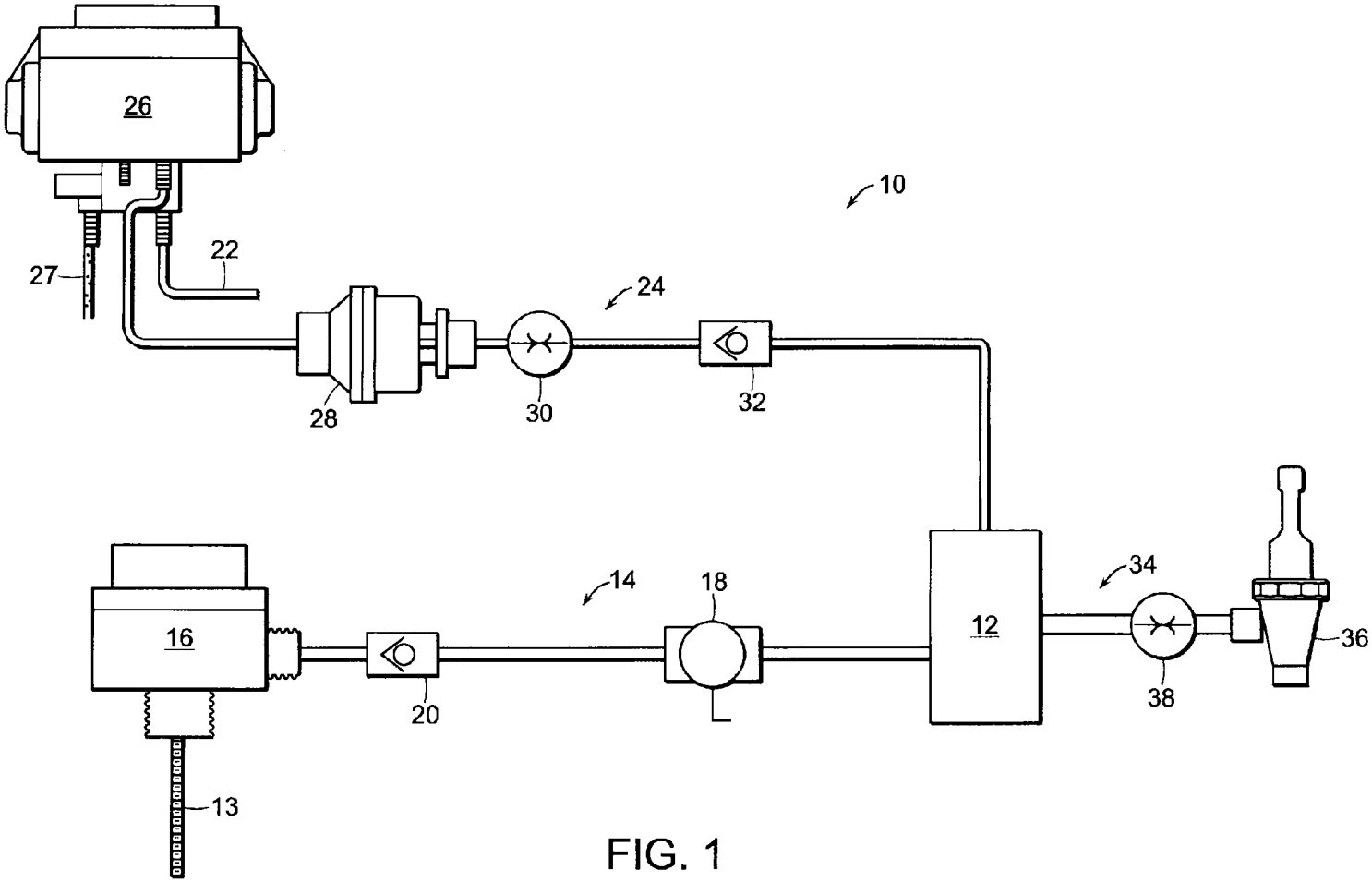
FIG. 1 is a diagrammatic illustration of a prior liquid delivery system.
Figure 2:
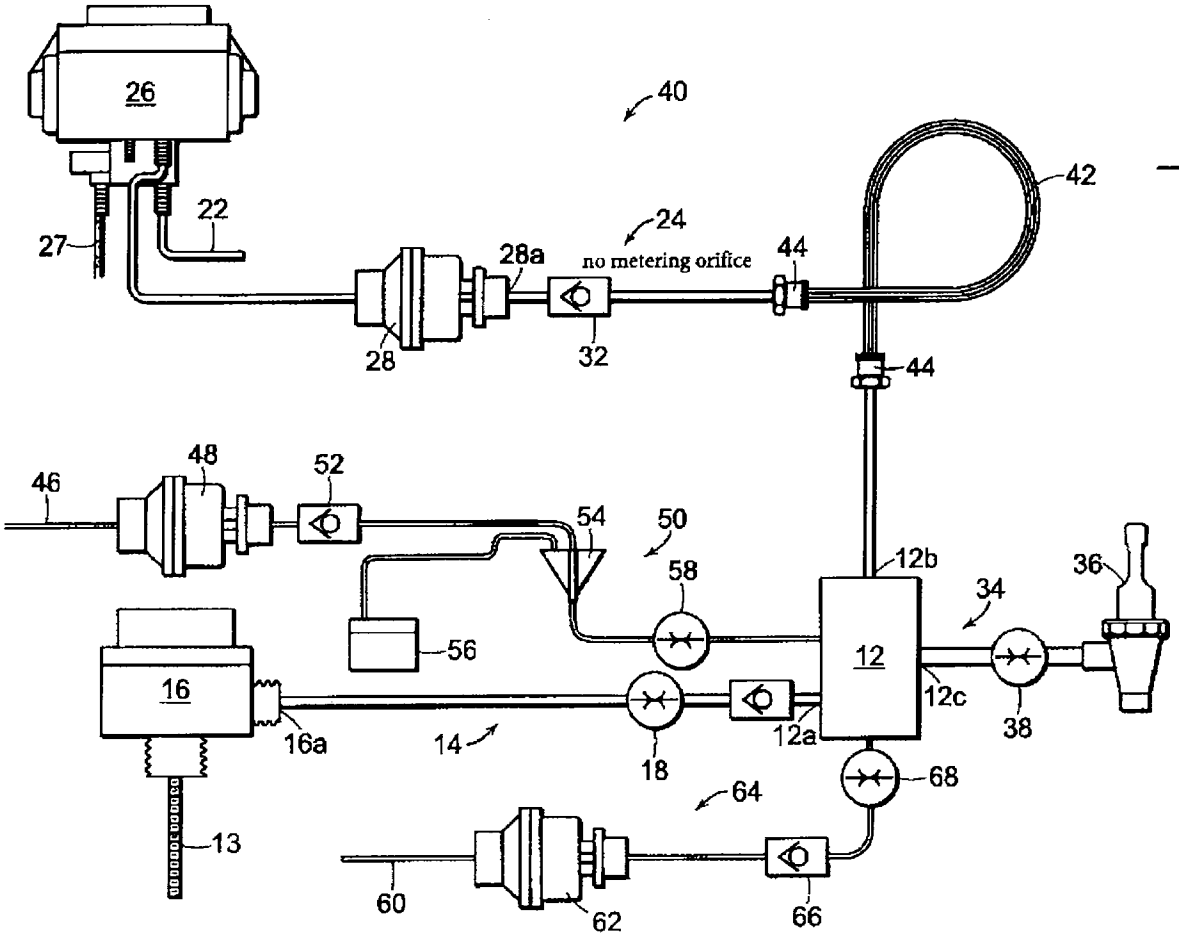
FIG. 2 is a diagrammatic illustration of a liquid delivery system in accordance with an exemplary embodiment of the present invention.

An exemplary embodiment of an on demand liquid mixing and delivery system embodying aspects of the present invention is depicted at 40 in FIG. 2. The same reference numbers have been employed to designate components of the system 40 that are similar or identical to those of the prior system 10 illustrated in FIG. 1.

The mixing chamber 12 has first and second inlets 12*a*, 12*b* and an outlet 12*c*. The first constant flow valve 16 has a first outlet 16*a* connected by supply line 14 to the first inlet 12*a*. The first constant flow valve 16 is adapted to deliver a first liquid to the mixing chamber 12 at a first pressure.

Similarly, the second constant flow valve 28 has a second outlet 28*a* connected by supply line 24 to the second inlet 12*b*. The second constant flow valve 28 is adapted to deliver a second liquid to the mixing chamber at a second pressure that is greater than the first delivery pressure of the first constant flow valve. The size of the second inlet 12*b* is at least as large as the second constant flow valve outlet 28*a*.

According to one aspect of the present invention, the second supply line 24 lacks any metering orifice. Instead, flow resistance to the second liquid being delivered to the mixing chamber is provided exclusively by the second supply line, and primarily by the length and/or internal size of at least one conduit section 42 of the second supply line. Advantageously, quick disconnect couplings 44 allow the conduit section 42 to be readily interchanged with other conduit sections having different lengths and/or internal sizes selected to provide different flow resistances suitable for liquids having different viscosities and/or levels of suspended solids. In comparison to conventional orifices, the conduit sections 42 are far less prone to plugging, and thus contribute advantageously to trouble free operation of the liquid delivery system.

According to another aspect of the present invention, an atomized third liquid is incorporated into the liquid mixture being delivered to the dispenser 36. Atomization may be achieved by compressed air received via conduit 46 and fed through a third constant flow valve 48 connected to the mixing chamber 12 by a third supply line 50.

The third supply line includes a check valve 52 and an atomizer 54, one non-limiting example being a Micro Mist Nebulizer available online at justnebulizers.com. The third liquid is drawn by the atomizer 54 from a container 56 and directed through a third metering orifice 58 and into mixing chamber 12 where it is combined with the first and second liquids.

Figure 3:
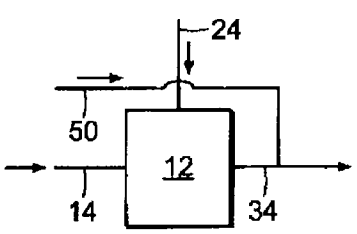
FIG. 3 is a diagrammatic illustration of an alternative manner of incorporating atomized liquid into the liquid mixture being delivered to the dispenser.

Alternatively, as depicted in FIG. 3, the third supply line 50 may bypass the mixing chamber 12 and may be connected to the discharge line 34.

According to still another aspect of the present invention, in order to enhance the mixture of liquids in the mixing chamber 12, compressed air received via conduit 60 and a fourth constant flow valve 62 may be introduced into the mixing chamber 12 via a fourth supply line 64 including a check valve 66 and a fourth metering orifice 68.

A typical non-limiting example of the use to which the above described system may be put is the on demand dispensing of tea at rates of between 1.0 and 2.0 oz/sec., where the mixture being fed to the on/off dispenser 36 includes water delivered to the mixing chamber 12 via supply line 14, a tea concentrate delivered via supply line 24, and an essense to enhance the tea aroma of the dispensed mixture delivered via supply line 50.

When dispensing the tea mixture at a rate of about 1.5 oz/sec., exemplary ratios of water to tea concentrate may range between 11/1 and 5/1, with the essence contributing about 0.001% of the mixture being provided to the dispenser. If enhanced mixing is required, compressed air at about 14.5 p.s.i may be introduced into the mixing chamber 12.

When the dispenser 36 is closed, back pressures in the supply lines 14, 24, 50 and 64 increase and contribute to a rise in the operating pressures of the constant flow valves 16, 28, 48 and 62 above their respective upper threshold levels, causing the valves to close. When the dispenser is opened, back pressures drop to levels permitting the constant flow valves to open and operate between their respective upper and lower threshold levels.

What is claimed is:

1. A system for the on demand delivery of a liquid mixture to an on/off dispenser, said system comprising:

a mixing chamber having first and second inlets and an outlet connected to said dispenser;

a first constant flow valve having a first outlet connected to said first inlet via a first supply line, said first constant flow valve being adapted to deliver a first liquid to said mixing chamber at a first substantially constant pressure; and a second constant flow valve having a second outlet, the size of said second inlet being at least as large as the size of said second outlet, a second supply line having an entry end and an exit end connected to said second inlet, said second constant flow valve being adapted to deliver a second liquid via said second supply line to said mixing chamber at a second pressure greater than said first pressure, said second supply line lacking any metering orifice between its entry and exit ends, with resistance to flow of said second liquid from said second outlet to said second inlet being provided primarily by the length and/or size of at least one conduit section of said second supply line between said entry and exit ends, said first and second liquids being combined in said mixing chamber for delivery as said liquid mixture via the outlet of said mixing chamber to said on/off dispenser;

wherein the flow resistance of said second supply line is provided primarily by the internal size of a conduit section of said second supply line;

wherein said conduit section is removable from said second supply line and readily interchangeable with other conduit sections having different lengths and/or internal sizes.

2. The system of claim 1 further comprising atomizing means for incorporating an atomized liquid into said liquid mixture.

3. The system of claim 2 wherein said atomized liquid is incorporated into said liquid mixture in said mixing chamber.

4. The system of claim 2 wherein said atomized liquid is incorporated into said liquid mixture in a discharge line.

5. The system of claim 1 further comprising means for introducing a pressurized gas into said mixing chamber to promote turbulence and enhance the mixture of said first and second liquid.

* * * * *